United States Patent [19]

Morimoto et al.

[11] Patent Number: 4,800,153

[45] Date of Patent: Jan. 24, 1989

[54] METHOD FOR PROCESSING SILVER HALIDE COLOR PHOTOGRAPHIC MATERIALS AND A COLOR PHOTOGRAPHIC DEVELOPER COMPOSITION COMPRISING HYDROXYLAMINE AND STABILIZER

[75] Inventors: Kiyoshi Morimoto; Takatoshi Ishikawa, both of Minami-ashigara, Japan

[73] Assignee: Fuji Photo Film Co., Ltd., Kanagawa, Japan

[21] Appl. No.: 74,983

[22] Filed: Jul. 17, 1987

[30] Foreign Application Priority Data

Jul. 18, 1986 [JP] Japan ..... 61-168159

[51] Int. Cl.[4] ..... G03C 7/30

[52] U.S. Cl. ..... 430/380; 430/372; 430/428; 430/429; 430/434; 430/464; 430/467; 430/484; 430/485; 430/490

[58] Field of Search ..... 430/376, 377, 428, 429, 430/434, 464, 467, 469, 484, 487, 489, 490, 380, 372, 485

[56] References Cited

U.S. PATENT DOCUMENTS

| | | | |
|---|---|---|---|
| 3,287,125 | 11/1966 | Green et al. | 430/484 |
| 3,293,034 | 12/1966 | Green et al. | 430/484 |
| 3,491,151 | 1/1970 | Bader | 430/484 |
| 3,996,054 | 12/1976 | Santemma et al. | 430/377 |

FOREIGN PATENT DOCUMENTS

| | | | |
|---|---|---|---|
| 0062451 | 5/1980 | Japan | 430/377 |
| 0158446 | 9/1985 | Japan . | |

*Primary Examiner*—Paul R. Michl
*Assistant Examiner*—Patrick A. Doody
*Attorney, Agent, or Firm*—Birch, Stewart, Kolasch & Birch

[57] ABSTRACT

There is provided a method for processing a silver halide color photographic material which comprises processing the silver halide color photographic material with a color developer containing an aromatic primary amine color developing agent and a specific amino compound. According to this method the stability and color forming property of a color developer are improved so that the increased fogging problem in continuous processing is lessened and the processing time is shortened. There is also provided a color developer composition which can be used as the developer, as it is or after adjusting its composition.

30 Claims, No Drawings

METHOD FOR PROCESSING SILVER HALIDE COLOR PHOTOGRAPHIC MATERIALS AND A COLOR PHOTOGRAPHIC DEVELOPER COMPOSITION COMPRISING HYDROXYLAMINE AND STABILIZER

BACKGROUND OF THE INVENTION (1) Field of the Invention

The present invention relates to a method for processing a silver halide color photographic material and a color photographic developer composition used in the method, and more particularly to a method for processing a silver halide color photographic material in which the stability and color forming property of a color photographic developer are improved, and the increased fogging problem in continuous processing is lessened; and a color developer composition which can afford the color developer.

(2) Description of the Prior Art

Color photographic developers (hereinafter referred to as color developers) using aromatic primary amine color developing agents have long been conventionally used in the color image forming process and now play a major role in the color photographic image forming process. However it is well known that the conventional color developers are liable to be easily oxidized in the presence of air or metals, and that if the developers thus changed with time are used to form a color image, fogging increases, and there are sensitivity or gradation changes such that the photographic characteristics become different from those desired.

Therefore, measures to improve the preservability of various color developers have been hitherto studied, and among others, the use of a combination of a hydroxyl amine and a sulfite ion is the most common general practice. However, when hydroxyl amine decomposes, ammonia is released, which causes fogging, and the sulfite ion acts as a competing compound to the developing agents, for example, to impede disadvantageously the color forming property, so that it cannot be said that both constitute preferable preservatives.

Hitherto, to improve the stability of color developers, various preservatives and chelating agents have been studied. For example, as preservatives, there can be mentioned aromatic polyhydroxy compounds described in Japanese Patent Application (OPI) Nos. 49828/1977, 160142/1984 and 47038/1981 and U.S. Pat. No. 3,746,544, hydroxylcarbonyl compounds described in U.S. Pat. No. 3,615,503 and British Pat. No. 1,306,176, α-aminocarbonyl compounds described in Japanese Patent Application (OPI) Nos. 143020/1972 and 89425/1978, alkanolamines described in Japanese Patent Application (OPI) No. 3532/1979, and metal salts described in Japanese Patent Application (OPI) Nos. 44148/1982 and 53749/1982. As chelating agents, there can be mentioned aminopolycarboxylic acids described in Japanese Patent Publication Nos. 30496/1973 and 30232/1969, organic phosphonic acids described in Japanese Patent Application (OPI) No. 97347/1981, Japanese Patent Publication No. 39359/1981, and West German Pat. No. 2,227,639, phosphonocarboxylic acids described, for example, in Japanese Patent Application (OPI) Nos. 102726/1977, 42730/1978, 121127/1979, 126241/1980 and 65956/1980 and compounds described, for example, in Japanese Patent Application (OPI) Nos. 195845/1983 and 203440/1983, and Japanese Patent Publication No. 40900/1978.

However, even if these prior techniques with their advantages are used, preservative performance is still inadequate or photographic characteristics remain adversely affected, so that fully satisfactory results have yet to be achieved.

In particular, in color developers free of benzyl alcohol which causes many problems regarding public hazards and the preparation of the solutions, the color forming properties are unavoidably deteriorated, and the above prior techniques are not satisfactory in many cases since preservatives acting as a competing compounds significantly impair the color forming properties.

In the case of color photographic materials containing a silver chlorobromide emulsion with a large amount of chlorine, fogging is liable to occur during color development as described in Japanese Patent Application (OPI) Nos. 95345/1983 and 232342/1984. When such an emulsion is used, it is essential to use a preservative that is less compatible with the emulsion and has better preservability, and as such the development of new developers is desirable.

BRIEF SUMMARY OF THE INVENTION

Therefore, an object of the invention is to provide a silver halide color photographic material that is excellent in stability and color forming property and is distinguished in that the increase in fogging, for example, in continuous processing is remarkably lowered.

Further, an object of the present invention is to provide a method of processing silver halide color photographic materials that is distinguished in that the color developer is improved in stability, on aging in continuous processing is remarkably lowered, and the increase in fogging is prevented.

Still further, an object of the invention is to provide a color developer composition which affords a color developer that is excellent in stability without lowering the density of the color formed even though it is free of benzyl alcohol.

Other and further objects, features and advantages of the invention will be detailed more fully in the following description.

DETAILED DESCRIPTION OF THE INVENTION

The above objects have been attained by a method of processing a silver halide color photographic material, which comprises processing the silver halide color photographic material with a developer including a developer composition that contains an aromatic primary amine color developing agent and a compound represented by the following formula (I-1) or (I-2):

Formula (I-1)

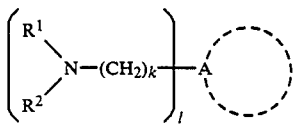

-continued

Formula (I-2)

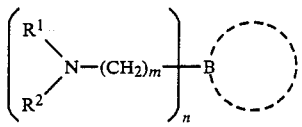

In the above formulae, $R^1$ and $R^2$, which may be the same or different, each represents a hydrogen atom or a substituted or unsubstituted alkyl, aryl or heterocyclic group (hereinafter and in claims referred to simply as alkyl, aryl or heterocyclic group).

A and B are an organic group composed of atoms selected from carbon, oxygen, nitrogen and sulfur atoms, and represent a saturated (for A) and unsaturated (for B) 5- to 6-membered ring respectively. A and B may have the same substituent as enumerated for $R^1$ and $R^2$, and may contain a fused benzene ring or a fused heterocyclic ring.

k and m are integers of 1 to 6, and l and n are integers of 1 to 3, provided that m+n is 3 or greater.

Examples of $R^1$ and $R^2$ include an alkyl group having 1~4 carbon atoms (e.g., methyl, ethyl, propyl, butyl, 2-hydroxyethyl, 3-sulfopropyl, 4-sulfobutyl, 4-sulfamoylbutyl), an aryl group having 6~10 carbon atoms (e.g., phenyl, p-hydroxyphenyl, p-methoxyphenyl) and a 5~6 membered heterocyclic group having oxygen, nitrogen or sulfur atom therein (e.g., pyridyl, thienyl, furyl).

Examples of A and B include a 5- or 6-membered organic cyclic group having 5~2 carbon atoms and 0~3 oxygen, nitrogen or sulfur atoms (e.g.; for A, piperidyl, piperidino, morpholino, cyclohexyl, oxolanyl, piperazinyl, pyrrolidinyl; for B, phenyl, furyl, pyridyl, thienyl, indolyl).

Examples of substituents that may be further substituted $R^1$ and $R^2$ include a hydroxyl group, an alkoxy group, an acyloxy group, an acylamino group, a sulfonylamino group, an alkoxycarbonyl group, an amino group, an alkyl-substituted amino group, a cyano group, a nitro group, a halogen atom, a sulfo group, a ureido group, a carbamoyl group, and a sulfamoyl group, having 0~10 carbon atoms.

Preferably, $R^1$ and $R^2$ each represents a hydrogen atom or an alkyl group, the substituted alkyl groups having 1~4 carbon atoms are, more preferably, alkyl groups having a hydrophilic functional group selected from a hydroxy group, a sulfo group, a sulfonylamino group and a sulfamoyl group.

Specific examples of compounds represented by formulae (I-1) and (I-2) are given below, but they are not meant to limit the invention.

I-(1)

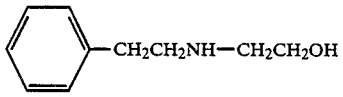

I-(2)

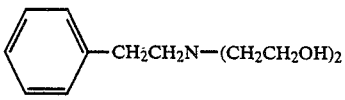

-continued

I-(3)

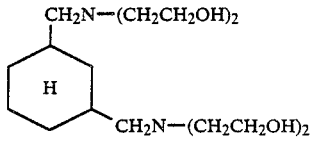

I-(4)

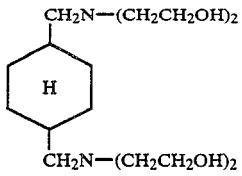

I-(5)

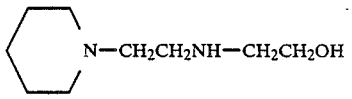

I-(6)

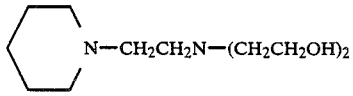

I-(7)

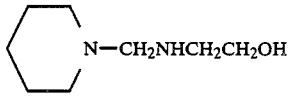

I-(8)

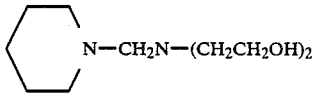

I-(9)

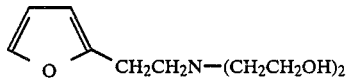

I-(10)

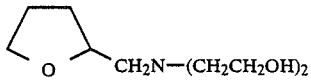

I-(11)

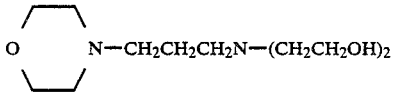

I-(12)

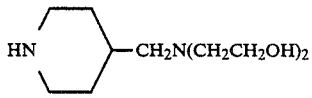

I-(13)

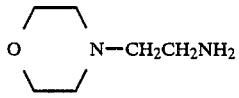

I-(14)

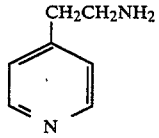

I-(15)

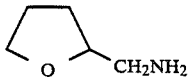

-continued

I-(16)

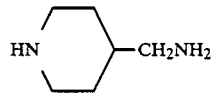

I-(17)

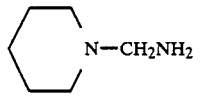

I-(18)

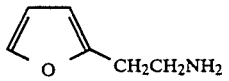

I-(19)

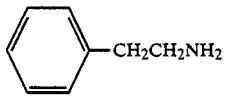

I-(20)

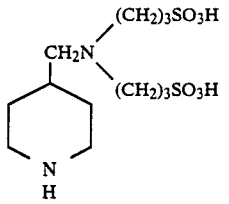

I-(22)

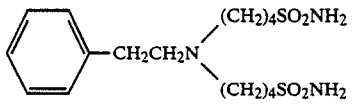

I-(23)

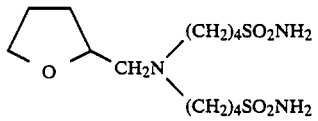

I-(24)

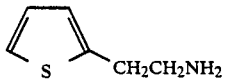

Specific synthesis examples of a compound represented by formulae (I-1) and (I-2) are given below.

Synthesis of Compound I-(2)

12.1 g of phenethylamine and 10 g of sodium hydroxide were dissolved in 100 ml of water, then 20.1 g of ethylene chlorohydrin were added dropwise thereto, and the mixture was heated for 4 hours under reflux. After it was allowed to cool, it was subjected to vacuum distillation using ethyl acetate to obtain compound I-(2). The yield was 8.4 g (40%).

In the present invention the color developer composition may be used as a color developer, as it is or after adjusting its composition.

In the present invention, the amount of a compound represented by formula (I-1) or (I-2) to be added is 0.01 to 50 g, preferably 0.1 to 20 g, per liter of color developer.

Now, the color developers of the present invention will be further described.

The color developer used in the present invention contains an ordinary aromatic primary amine color developing agent. Preferred examples of aromatic primary amine color developing agents are p-phenylenediamine derivatives. Representative examples are given below, but they are not meant to limit the present invention:

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxylethyl)amino]aniline

D-5: 2-methyl-4-[N-ethyl-N-(β-hydroxyethyl-)amino]aniline

D-6: N-ethyl-N-(β-methanesulfonamidoethyl)-3-methyl-4-aminoaniline

D-7: N-(2-amino-5-diethylaminophenylethyl)methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

These p-phenylenediamine derivatives may be used in the form of salts such as sulfates, hydrochlorides, sulfites and p-toluenesulfonates. The amount of the aromatic primary amine developing agent to be used is about 0.1 g to about 20 g, preferably about 0.5 g to about 10 g, per liter of developer.

Preferably, the color developer used in the present invention contains a hydroxylamine compound represented by the following general formula (II):

General formula (II)

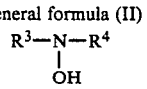

wherein $R^3$ and $R^4$ represent a hydrogen atom, a substituted or unsubstituted alkyl, alkenyl or aryl group (hereinafter and in claims simply referred as alkyl, alkenyl or aryl group).

Examples of $R^3$ and $R^4$ include an alkyl group having 1~10 carbon atoms (e.g., methyl, ethyl, methoxyethyl, ethoxyethyl, n-propyl, iso-propyl, n-butyl, methoxyethoxyethyl, carbamoylethyl, benzyl), alkenyl group having 2~10 carbon atoms (e.g., allyl, vinyl, isopropenyl, propenyl, butenyl) and aryl group having 6~10 carbon atoms (e.g., phenyl, p-carboxyphenyl, p-hydroxyphenyl).

Preferably, $R^3$ and $R^4$ represent an alkyl group or an alkenyl group, and it is more preferable that one of them has a substituent. $R^3$ and $R^4$ together may form a heterocyclic ring through the nitrogen atom.

The alkyl group and the alkenyl group may be straight- or branched-chain, or cyclic, and the substituents include a halogen atom (e.g., F, Cl and Br), an aryl group (e.g., a phenyl group and a p-chlorophenyl group), an alkoxy group (e.g., a methoxy group, an ethoxy group and a methoxyethoxy group), an aryloxy group (e.g., a phenoxy group), a sulfonyl group (e.g., a methanesulfonyl group and a p-toluenesulfonyl group), a sulfonamide group (e.g., a methanesulfonamido group and a benzenesulfonamido group), a sulfamoyl group (e.g., a diethylsulfamoyl group and an unsubstituted sulfamoyl group), a carbamoyl group (e.g., an unsubstituted carbamoyl group and a diethylcarbamoyl group), an amido group (e.g., an acetamido group and a benzamido group), a ureido group (e.g., a methylureido group and a phenylureido group), an alkoxycarbonylamino group (e.g., a methoxycarbonylamino groups), an aryloxycarbonylamino group (e.g., a phenoxycarbonylamino group), an alkoxycarbonyl group (e.g., a methoxycarbonyl group), an aryloxycarbonyl group (e.g., a phenoxycarbonyl group), a cyano group, a hydroxy group, a carboxy group, a sulfo group, a nitro group, an amino group (e.g., an unsubstituted amino group and a diethylamino group), an alkylthio group (e.g., a methylthio group), an arylthio group (e.g., a phenylthio group) and a heterocyclic group (e.g., a morpholinyl group and a piridyl group). $R^3$ and $R^4$ may be the same or different, and substituents on $R^3$ and $R^4$ may be the same or different.

Preferably $R^3$ and $R^4$ have 1 to 10 carbon atoms, more preferably 1 to 5 carbon atoms. Nitrogen-containing heterocyclic rings that may be formed by $R^3$ and $R^4$ include a piperidyl group, a pyrrolidyl group, an N-alkylpiperazyl, a morpholinyl group, an indolinyl group, and a benztriazole group.

Preferred substituents in $R^3$ and $R^4$ are a hydroxyl group, an alkoxy group, an alkylsulfonyl group, an arylsulfonyl group, an amido group, a carboxyl group, a cyano group, a sulfo group, a nitro group, and an amino group.

Specific examples of compounds represented by formula (II) used in the present invention are given below, but they are not meant to limit the scope of the present invention.

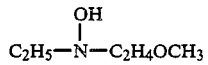
II-(1)

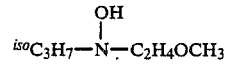
II-(2)

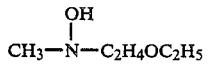
II-(3)

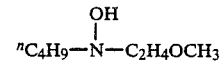
II-(4)

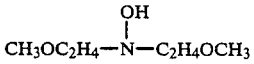
II-(5)

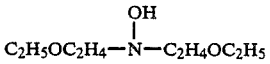
II-(6)

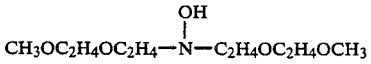
II-(7)

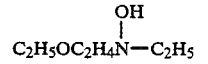
II-(8)

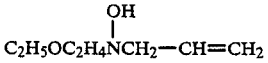
II-(9)

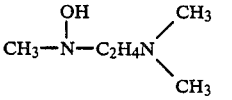
II-(10)

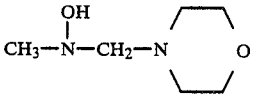
II-(11)

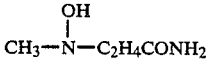
II-(12)

-continued

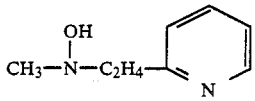
II-(13)

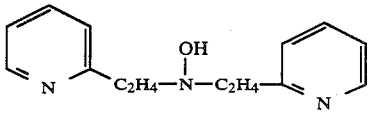
II-(14)

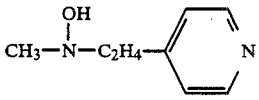
II-(15)

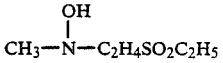
II-(16)

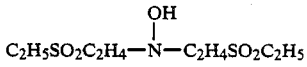
II-(17)

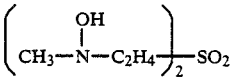
II-(18)

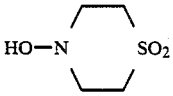
II-(19)

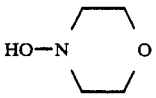
II-(20)

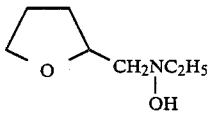
(II-(21)

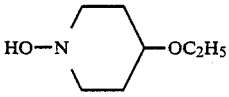
II-(22)

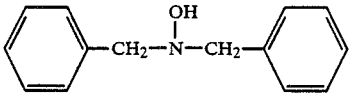
II-(23)

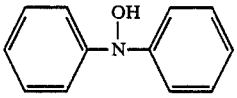
II-(24)

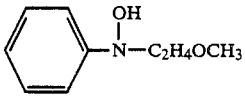
II-(25)

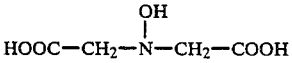
II-(26)

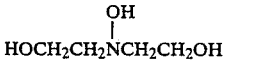
II-(27)

-continued

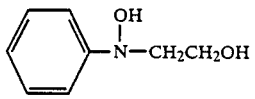

II-(28)

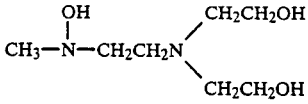

II-(29)

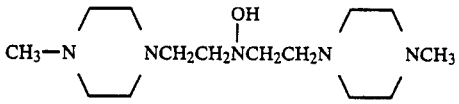

II-(30)

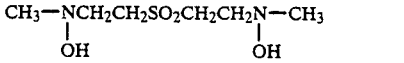

II-(31)

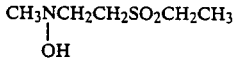

II-(32)

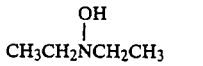

II-(33)

Compounds represented by general formula (II) can be synthesized by known processes as described in U.S. Pat. Nos. 3,661,996, 3,362,961 and 3,293,034, Japanese Patent Publication No. 2794/1967, and U.S. Pat. Nos. 3,491,151, 3,655,764, 3,467,711, 3,455,916, 3,287,125 and 3,287,124.

These compounds may be salts with acids such as hydrochloric acid, sulfuric acid, nitric acid, phosphoric acid, oxalic acid, and acetic acid.

The amount of compounds represented by formula (II) to be added to a color developer is 0.1 g to 20 g, preferably 0.5 to 10 g, per liter of the color developer.

It is preferable, in view of the prevention of environmental contamination, preparation of a solution, and the prevention of fogging, that the present color developer be substantially free of benzyl alcohol. Herein, the term "substantially free of benzyl alcohol" means that the amount of benzyl alcohol per liter of color developer is no more than 2 ml, more preferably benzyl alcohol should not be present at all.

Preservatives which may be added to the color developer, if required, include sulfites such as sodium sulfite, potassium sulfite, sodium bisulfite, potassium bisulfite, sodium metasulfite and potassium metasulfite, or carbonyl sulfite adducts. The amount of these to be added is 0 g to 20 g/liter, preferably 0 g to 5 g/liter, and if the stability of a color developer is secure, a smaller amount is preferred.

Examples of other preservatives are hydroxyacetones described in U.S. Pat. No. 3,615,503 and British Pat. No. 1,306,176, α-aminocarbonyl compounds described in Japanese Patent Application (OPI) Nos. 143020/1977 and 89425/1978, metals described in Japanese Patent Application (OPI) Nos. 44148/1982 and 53749/1982, saccharides described in Japanese Patent Application (OPI) No. 102727/1977, hydroxamic acids described in Japanese Patent Application (OPI) No. 27638/1972, α,α'-dicarbonyl compounds described in Japanese Patent Application (OPI) No. 160141/1984, salicyclic acids described in Japanese Patent Application (OPI) No. 180588/1984, alkanolamines described in Japanese Patent Application (OPI) No. 3532/1979, polyalkylimines described in Japanese Patent Application (OPI) No. 94349/1981, and gluconic acid derivatives described in Japanese Patent Application (OPI) No. 75647/1981. Two or more of these can be combined if required.

The addition of aromatic polyhydroxy compounds is preferable.

Preferably, the pH of the color developer of the present invention should be 9 to 12, more preferably 9 to 11.0, and other known compounds that are components of conventional developers can be added.

To retain the pH, preferably, various buffer agents may be added to the color developer.

Buffer agents include carbonates, phosphates, borates, tetraborates, hydroxybenzoates, glycine salts, N,N-dimethylglycine salts, leucine salts, norleucine salts, guanine salts, 3,4-dihyroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are excellent in solubility and buffer performance at a high pH of 9.0 or higher, and when added to the color developer there are no adverse effects (e.g., fogging) on photographic performance. Additionally they are inexpensive, so it is particularly preferable to use these buffer agents.

Examples of these buffer agents are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

Preferably, the amount of the buffer agent to be added to the color developer is 0.1 mol/liter or over, more preferably 0.1 mol/liter to 0.4 mol/liter.

Various chelating agents can be used in the color developer to serve as suspension agents for calcium and magnesium or to improve stability.

As chelating agents preferably are used organic acid compounds such as aminopolycarboxylic acids described in Japanese Patent Publication Nos. 30496/1973 and 30232/1969, organic phosphonic acids described in Japanese Patent Application (OPI) No. 97347/1981, Japanese Patent Publication No. 39359/1981 and West German Pat. No. 2,227,639, phosphonocarboxylic acids described, for example, in Japanese Patent Application (OPI) Nos. 102726/1977, 42730/1978, 121127/1979, 126241/1980 and 65956/1980, and compounds described, for example, in Japanese Patent Application (OPI) Nos. 195845/1983 and 203440/1983, and Japanese Patent Publication No. 40900/1978. Specific examples are given below, but the present invention is not limited to them:

nitrilotriacetic acid,
diethylenetriaminepentaacetic acid,
ethylenediaminetetraacetic acid,
triethylenetetraminehexaacetic acid,
N,N,N-trimethylenephosphonic acid,
ethylenediamine-N,N,N',N'-tetramethylenephosphonic acid,
1,3-diamino-2-propanol-tetraacetic acid,
transcyclohexanediaminetetraacetic acid, nitrilotetrapropionic acid,
1,2-diaminopropanetetraacetic acid,
hydroxyethyliminodiacetic acid,
glycol ether diaminetetraacetic acid,
hydroxyethylenediaminetriacetic acid,
ethylenediamineorthohydroxyphenylacetic acid,
2-phosphonobutane-1,2,4-tricarboxylic acid,
1-hydroxyethylidene-1,1-diphosphonic acid and
N,N'-bis(2-hydroxybenzyl)ethylenediamine-N,N'-diacetic acid.

Two or more of these chelating agents may be combined if required.

The amount of these chelating agents to be added may be such an amount enough to sequester the metal ions in the color developer, for example on the order of 0.1 to 10 g per liter.

If required, an arbitrary development accelerator may be added to the color developer. As development accelerators can be mentioned thioether type compounds disclosed, for example, in Japanese Patent Publication Nos. 16088/1962, 5987/1962, 7826/1963, 12380/1969 and 9019/1970, and U.S. Pat. No. 3,813,247, p-phenylenediamine compounds disclosed in Japanese Patent Application (OPI) Nos. 49829/1977 and 15554/1975, quaternary ammonium salts disclosed, for example, in Japanese Patent Application (OPI) No. 137726/1975, Japanese Patent Publication No. 30074/1969 and Japanese Patent Application (OPI) Nos. 156826/1981 and 43429/1977, p-aminophenols described in U.S. Pat. Nos. 2,610,122 and 4.119,462, amine type compounds described, for example, in U.S. Pat. Nos. 2,494,903, 3,128,182, 4,230,796 and 3,253,919, Japanese Patent Publication No. 11431/1966 and U.S. Pat. Nos. 2,482,546, 2,596,926 and 3,582,346, polyalkylene oxides disclosed, for example, in Japanese Patent Publication Nos. 16088/1962 and 25201/1967, U.S. Pat. No. 3,128,183, Japanese Patent Publication Nos. 11431/1966 and 23883/1967, and U.S. Pat. No. 3,532,501, as well as 1-phenyl-3-pyrazolidones, hydrazines, meso-ionic type compounds, ionic type compounds and imidazoles, which can be added as needed.

In the present invention an arbitrary antifoggant can be added if required. Antifoggants which can be used include alkali metal halides such as sodium chloride, potassium bromide and potassium iodide, and organic antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazoles and hydroxyazaindolizineadenine.

It is preferable that the present color developer contains a brightening agent. Preferable brightening agents are 4,4'-diamino-2,2'-disulfostilbene compounds. The amount of brightening agent to be added is 0 to 5 g/liter, preferably 0.1 to 4 g/liter.

If needed, surface active agents such as alkyl sulfonic acids, aryl phosphonic acids, aliphatic carboxylic acids, and aromatic carboxylic acids may be added.

The processing temperature using the present color developer is 20° to 50° C., preferably 30° to 40° C. The processing time is 20 sec to 5 min, preferably 30 sec to 2 min. It is preferable that the replenishing amount be small, generally 20 to 600 ml, preferably 50 to 300 ml, and more preferably 100 to 200 ml, per $m^2$ of the photographic material.

Now, the bleaching solution, the bleach-fix solution and the fixer used in the present processing method are described.

Though any bleaching agent may be used in the bleaching solution of the bleach-fix solution of the present invention, it is preferable to use organic complex salts of iron(III) (e.g., complex salts of aminopolycarboxylic acids such as ethylenediaminetetraacetic acid and diethlenetriaminepentaacetic acid, and aminopolyphosphonic acids, phosphonocarboxylic acids and organic phosphonic acid), organic acids such as citric acid, tartaric acid and malic acid, persulfates, and hydrogen peroxide. Of these, organic complex salts of iron (III) are particularly preferable in view of rapid processing and the prevention of environmental contamination. Aminopolycarboxylic acids, aminopolyphosphonic acids or organic phosphonic acids useful for forming organic complex salts of iron (III) include ethylenediaminetetraacetic acid, diethylenetriaminepentaacetic acid, ethylenediamine-N-(β-oxyethyl)-N,N',N'-triacetic acid, 1,3-diaminopropanetetraacetic acid, triethylenetetraminehexaacetic acid, propylenediaminetetraacetic acid, nitrilotriacetic acid, nitrilotripropionic acid, cyclohexanediaminetetraacetic acid, 1,3-diamino-2-propanoltetraacetic acid, methyliminodiacetic acid, iminodiacetic acid, hydroxyliminodiacetic acid, dihydroxyethylglycineethyl ether diaminotetraacetic acid, glycol ether diaminetetraacetic acid, ethylenediaminetetrapropionic acid, ethylenediaminedipropionic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and 1-hydroxyethylidene-1,1-diphosphonic acid.

These compounds may be any one of sodium salt, potassium salt, lithium salt and ammonium salt. Of these compounds, it is preferable to use iron (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid, since their bleaching power is high.

These ferric ion complex salts may be used in the form of a complex salt, or a ferric ion complex salt may be formed in solution using a ferric salt such as ferric sulfate, ferric chloride, ferric nitrate, ammonium iron(III) sulfate and ferric phosphate and a chelating agent such as an aminopolycarboxylic acid, an aminopolyphosphonic acid and a phosphonocarboxylic acid. One or more complex salts may be used. On the other hand, one or more ferric salts can be used to form complex salts in solution by using ferric salts and a chelating agent. Further, one or more chelating salts may be used. In either case, a chelating agent is used in excess to form a ferric ion complex salt. Of iron complex salts, aminopolycarboxylic acid iron complex salts are preferable, and the amount used is 0.01 to 1.0 mol/liter, preferably 0.05 to 0.50 mol/liter.

Further, if required, the bleaching solution or the bleach-fix solution may have a bleach accelerating agent. As specific examples of useful bleach accelerating agents can be mentioned compounds having a mercapto group or a disulfido group described, for example, in U.S. Pat. No. 3,893,858, West German Pat. Nos. 1,290,812 and 2,059,988, Japanese Patent Application (OPI) Nos. 32736/1978, 57831/1978, 37418/1978, 65732/1978, 72623/1978, 95630/1978, 95631/1978, 104232/1978, 124424/1978, 141623/1978 and 28426/1978, and Research Disclosure No. 171129 (July 1978), thiazolidine derivatives as described in Japanese Patent Application (OPI) No. 140129/1975, thiourea derivatives described in Japanese Patent Publication No. 8506/1970, Japanese Patent Application (OPI) Nos. 20832/1977 and 32735/1978 and U.S. Pat. No. 3,706,561, iodides described in West German Pat. No. 1,127,715 and Japanese Patent Application (OPI) No. 16235/1983, polyethylene oxides described in West German Pat. Nos. 966,410 and 2,748,430, polyamine compounds described in Japanese Patent Publication No. 8836/1970, and iodine and bromine ions and compounds described in Japanese Patent Application (OPI) Nos. 42434/1974, 59644/1974, 94927/1978, 35727/1979, 26506/1980 and 163940/1983. Of these, compounds having a mercapto group or a disulfido group are preferable in view of high acceleration effects, and in particular compounds described in U.S. Pat. No. 3,893,858, West German Pat. No. 1,290,812, and Japanese Patent Application (OPI) No. 95630/1978 and more preferable.

Further, the bleaching solution or bleach-fix solution used in the present invention may contain a rehalogenating agent such as a bromide (e.g., potassium bromide, sodium bromide and ammonium bromide), a chloride (e.g., potassium chloride, sodium chloride and ammonium chloride) or an iodide (e.g., ammonium iodide). If needed, one or more inorganic acids or organic acids and their metal salts or ammonium salts having a pH buffering effect such as boric acid, borax, sodium metaborate, acetic acid, sodium acetate, sodium carbonate, potassium carbonate, phosphorous acid, sodium phosphate, citric acid, sodium citrate and tartaric acid, or a corrosion inhibitor such as guanidine and ammonium nitrate can be added. Sodium phosphate, citric acid, sodium citrate and tartaric acid, or a corrosion inhibitor such as guanidine and ammonium nitrate can be added.

In the present invention, the fixing agent used in the bleach-fix solution or the fixer can be a known fixing agent, that is, a thiosulfate such as sodium thiosulfate and ammonium thiosulfate; a thiocyanate such as sodium thiocyanate and ammonium thiocyanate; a thioether compound such as ethylenebisthioglycolic acid and 3,6-dithia-1,8-octanediol and a thiourea; being a water-soluble silver halide dissolving agent. Two or more of these compounds may be combined. Further, for example, a special bleach-fix solution comprising a combination of a large amount of a halide such as potassium iodide and a fixing agent described in Japanese Patent Application (OPI) No. 155354/1980 can be used. In the present invention, it is preferable to use a thiosulfate, particularly ammonium thiosulfate. Preferably the amount of a fixing agent used per liter of the bath is in the range of 0.3 to 2 mol, more preferably 0.5 to 1.0 mol.

Preferably, the pH range of the bleach-fix solution or fixer in the present invention may be 3 to 10, more preferably 5 to 9. When the pH is lower than that, though the desilvering ability may be improved, deterioration of the solution and leucolization of cyan dyes are facilitated. By contrast, when the pH is higher than that, the desilvering becomes slow, and staining is liable to occur.

To adjust the pH, for example, hydrochloric acid, sulfuric acid, nitric acid, acetic acid, a bicarbonate, ammonia, caustic potash, caustic soda, sodium carbonate or potassium carbonate can be added as required.

Further, the bleach-fix solution can contain a brightening agent, an antifoamer, a surface active agent, and an organic solvent such as polyvinylpyrrolidone and methanol.

The bleach-fix solution or the fixer in the present invention contain, as a preservative, a sulfite ion releasing compound such as a sulfite (e.g., sodium sulfite, potassium sulfite and ammonium sulfite), a bisulfite (e.g., ammonium bisulfite, sodium bisulfite and potassium bisulfite) and a metabisulfite (e.g., potassium metabisulfite, sodium metabisulfite and ammonium metabisulfite). Preferably, these compounds are contained in an amount of about 0.02 to 0.50 mol/liter, more preferably 0.04 to 0.40 mol/liter in terms of sulfite ion.

Although a sulfite is generally added as a preservative, an ascorbic acid and a carbonyl-bisulfite adduct or a carbonyl compound can be used.

Further, there may be added as needed such a constituent as a buffering agent, brightening agent, chelating agent or antifungal agent.

Turning to the washing step in this invention, water-washing treatment may be replaced by a simple washing treatment such as so-called "stabilization processing", in which no water-washing step is substantially contained. Thus, the water-washing step of this invention should be broadly interpreted.

Although it is difficult to define an amount of water in the washing step in this invention (because it differs depending, for example, on the number of baths in the counter flow washing process or the carry-over amount of the forward bath constituent by the photographic material), it is preferred in this invention that the concentration of the constituents of the bleaching or fix solution in the last washing bath be $1\times10^{-4}$ mol/l or less. For example, in the case of three-tank counter flow washing, the preferable amount of washing water to be used is 1000 ml or more, more preferably 5000 ml or more, per square meter of photographic material. In the case of a water saving processing, an amount of water in the range of 100–1000 ml per square meter of photographic material is preferable.

The temperature of the washing step is in the range of 15°–45° C., more preferably in the range of 20°–35° C.

Water for the washing step may be incorporated with a variety of known compounds to prevent precipitation or to stabilize the washing water. For example, a chelating agent such as inorganic phosphoric acid, aminopolycarboxylic acid, and organic phosphonic acid; various germicide or antifungal agents, e.g., a compound as described in *J. Antibact. Antifug. Agents* Vol. 11, No. 5, pp. 207–223 (1983), and a compound described in "The Chemistry of Germicide and Antifungal Agents" by Hiroshi Horiguchi; a metallic salt represented by magnesium salt or aluminum salt; an alkaline metal salt or ammonium salt; or a surfactant for reducing drying load and to prevent precipitation may be added if necessary. A compound such as described in West, *Phot. Sci. Eng.* Vol. 6, pp. 344–359 (1965), may also be added.

Furthermore, this invention is particularly effective with a multi step (over two steps) counter flow washing process in which a chelating agent and a germicide or antifungal agent is added to save on the amount of washing water. This invention is also particularly effective in employing a multi step counter flow stabilization treatment process (i.e., stabilization processing), described in Japanese Patent Application (OPI) No. 8543/1982, instead of an ordinary water washing process. In these cases, the contents of the bleaching or fixing constituents in the last bath are preferably $5\times10^{-2}$ mol/l or less, more preferably $1\times10^{-2}$ mol/l or less.

Various compounds are added to the stabilization bath of this invention for image stabilization. Examples of these additives include a variety of buffering agents (e.g., an optional combination of borate, metaborate, borax, phosphate, carbonate, potassium hydroxide, sodium hydroxide, aqueous ammonia, monocarboxylic acid, dicarboxylic acid, and polycarboxylic acid) and an aldehyde such as formalin for adjusting pH of the membrane (e.g., pH 3–8). In addition, chelating agents (e.g., inorganic phosphoric acid, aminopolycarboxylic acid, organic phosphonic acid, aminopolyphosphonic acid, or phosphonocarboxylic acid), germicides (e.g., thiazoles, isothiazoles, halogenated phenols, sulfanilamides, or benzotriazoles), a surfactant, brightening agent, hardening agent and other additives may be respectively used alone or in combination for the same or differing purposes.

The addition of ammonium salts, such as ammonium chloride, ammonium nitrate, ammonium sulfate, ammonium phosphate, ammonium sulfite and ammonium thiosulfate, for adjusting the pH of the processer membrane is preferable in view of the improvement of photographic image preservability.

When the amount of washing water is to be conserved, as described above, it is preferable to feed back a part or all of the overflowed washing water into a forward bath such as a bleach-fix or fixing bath to reduce the amount of waste water.

In the continuous processing of this invention, a constant finished photography is attainable by preventing variations of each processing liquid's composition by adding each replenisher. The amount of replenisher to be added can be reduced to half or less the standard amount of replenisher for cost-savings.

Each processing bath may be provided with a heater, temperature sensor, level sensor, circulating pump, filter, floating lid, squeezer, and agitation by nitrogen gas or air, as required.

The method of this invention can be applied to any processing process using color developer. For example, it can be applied to a method of processing a color paper, a color reversal paper, color positive film, color negative film, or color reversal film.

The silver halide emulsion of the silver halide color photographic material to be used in this invention may be any type of halogen composition including silver iodobromide, silver bromide, silver chlorobromide, or silver chloride. A silver chlorobromide emulsion containing 60 mol% or more of silver chloride or a silver chloride emulsion is preferable in low-replenisher processing and to speed up the processing. A silver halide emulsion containing 80–100 mol% or silver chloride is most preferable. If it is needed to keep a high sensitivity and also to restrain a fogging to a very low level at the time of production preservation and/or processing, a silver chlorobromide emulsion or a silver bromide emulsion containing 50 mol% or more of silver bromide is preferable, with 70 mol% or more being more preferable. As the amount of silver bromide contained exceeds 90 mol%, the rapid processing may be difficult, but the development would be accelerated in same degree regardless of the contents of the silver bromide by using the accelerating means. For example, the means described below, which use the solvent of the silver halide or the development accelerator such as a fogging agent or development agent at the time of processing, are preferable. In any case, it is not preferable to contain a large amount of silver bromide, and a content under 3 mol% is preferred.

The silver halide crystals of the silver halide emulsion in this invention may have such a structure that the internal phase differs from the surface phase, the entire crystals may have a uniform phase, they may be polyphase with a joining structure, or a mixture thereof.

The average size of the silver halide grains, expressed in terms of the grain diameter for spherical or semi-spherical grains and in terms of the edge length for cubic grains can be determined as the average of the projected area diameter etc., and it is preferably smaller than 2 microns and larger than 0.1 microns, most preferably smaller than 1.5 microns and larger than 0.15 microns.

The distribution of grain size may be either narrow or wide. A monodisperse emulsion of silver halide may be employed in the present invention. The monodisperse emulsion may have a fluctuation coefficient as a monodisperse index of 20% or less, preferably 15% or less, which coefficient is obtained by dividing the standard deviation calculated from the curve of the size distribution by the average particle size. In order to realize the gradation desired for the photographic material, two or more monodisperse silver halide emulsions differing in grain size may be mixed in a single layer, or coated as different layers having essentially the same color sensitivity. Further, two or more polydisperse silver halide emulsions or a combination of monodisperse and polydisperse emulsions can be employed as a mixture in one layer, or coated as different layers.

Silver halide grains for use in this invention may have a regular crystal structure each as cubic, hexahedral, rohmbic dodecahedral or tetradecahedral structure, an irregular crystal structure such as a spherical structure, or a composite crystal structure thereof. Tabular grains may be employed wherein at least 50 percent of the total projected area of silver halide grains is tabular grains having a diameter-to-thickness ratio of about 5 or more, particularly of about 8 or more. Silver halide emulsions may be a mixture of various crystal structures. Silver halide grains may be used which form a latent image primarily on the grain surface, or which form a latent image primarily in the interior of the grains.

The photographic emulsion for use in this invention can be prepared by the processes described in P. Glafkides, *Chemie et Physique Photographique,* Paul Montel (1967), G. F. Duffin, *Photographic Emulsion Chemistry,* The Focal Press (1966), V. L. Zelikman et al., *Making and Coating Photographic Emulsions,* The Focal Press (1964), etc. Any one of an acidic process, a neutral process, and an ammoniacal proces can be used. As a means of reacting a soluble silver salt with a soluble halide salt, any of the single jet method, double jet method or a combination thereof may be employed.

A process of forming grains in the presence of excess silver ion (the so-called reversal mixing process) can be employed as well. As one type of the double jet method, the "controlled double jet" process can be employed wherein the pAg in the liquid phase of silver halide formation is kept constant. This process provides a silver halide emulsion containing regular silver halide grains having an approximately monodisperse particle size.

In addition there can be used a silver halide emulsion prepared by the so-called conversion method, comprising a process to convert a silver halide formed during the silver halide formation process to a more insoluble silver halide, and a silver halide emulsion subjected to the conversion treatment after silver halide formation is finished.

During formation or physical ripening of the silver halide grains, cadmium salts, zinc salts, lead salts, thallium salts, iridium salts or the complex salts thereof, rhodium salts or the complex salts thereof, iron salts or the complex salts thereof, etc., may also be present.

After grain formation followed by the usually physical ripening, desalting and chemical ripening, silver halide emulsions are used for coating.

Precipitation, physical ripening and chemical ripening can be carried out in the presence of conventional silver halide solvents (e.g., ammonia, potassium thiocyanate, thioethers and thiones described in U.S. Pat. No. 3,271,157, Japanese Patent Application (OPI) Nos. 12360/1976, 82408/1978, 144319/1978, 100717/1979 and 155828/1979). Removing of soluble salts from emulsions after physical ripening can be achieved by noodle washing, flocculation precipitation or ultrafiltration, etc.

Sulfur sensitization using active gelatine or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidinesulfinic acid, silane compounds, etc.); and noble metal sensitization using noble metal compounds (e.g., complex salts of the Group VIII metals such as Pt, Ir, Pd, Rh, Fe, etc., as well as gold complex salts) can be employed alone or in combination.

Each of blue-sensitive emulsion, green-sensitive emulsion and red-sensitive emulsion is subjected to spectral sensitization with dyes such as methine or the like. Useful dyes include cyanine dyes, mercocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes.

These dyes may have any of the following basic heterocyclic nuclei which are commonly used for cyanine dyes: pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus. Those nuclei formed by condensation of the above-mentioned nuclei with an aliphatic hydrocarbon ring or aromatic hydrocarbon ring, such as indolenine nucleus, benzidolenine nucleus, indole nucleus, benzoxazole nucleus, naphthoxazole nucleus, benzothiazole nucleus, naphthothiazole nucleus, benzoselenazole nucleus, benzimidazole nucleus, napthoimidazole nucleus, quinoline nucleus, and imidazo-(4,5-b)-quinoquizaline nucleus. These nuclei may be substituted on the carbon atom.

The merocyanine dye or compound merocyanine dye may have, as a nucleus having the ketomethylene structure, a 5- or 6-membered hetero ring nucleus such as pyrazolin-5-on nucleus, thiohydantoin nucleus, 2-thiooxazolidine-2,4-dione nucleus, thiazolidine-2,4-dione nucleus, rhodanine nucleus, thiobarbituric acid, 2-thioselenazolidine-2,4-dione nucleus, pyrazolo[1,5-a]benzimidazole, and pyrazolo[5,1-b]quinazolone nucleus.

Theswe sensitizing dyes may be used alone or in combination. A combination of sensitizing dyes is often employed particularly for the purpose of supersensitization. Typical examples are described in U.S. Pat. Nos. 2,688,545, 2,977,229, 3,397,060, 3,522,052, 3,527,641, 3,617,293, 2,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/1968 and 12375/1978, and Japanese Patent Application (OPI) Nos. 110618/1977 and 109925/1977.

Together with the sensitizing dye, a supersensitizing substance such as a dye which itself is not sensitizing or a substance which substantially does not absorb visible light may be incorporated in the emulsion.

These sensitizing dyes may be added in any step, including during grain formation, before, during, or after the chemical sensitization, or during coating. Adding these dyes during grain formation is effective not only in enhancing their adsorption but also in controlling the structure of crystals and the inner structure of grains. And adding these dyes at the chemical sensitization process is effective not only in enhancing the adsorption, but also in controlling the site of chemical sensitization and in preventing the deformation of crystals. These methods of adding sensitizing dyes to the emulsion containing a large amount of silver halide is especially effective. Further, applying these dyes to the grains which have higher contents of silver bromide or silver iodide on their grain surface is especially effective.

Dye-forming couplers for incorporation in the present photographic materials are preferably nondiffusible by being ballasted or polymerized. Two-equivalent couplers having a coupling-off group at the coupling active position are more preferable than four-equivalent couplers having only hydrogen at the coupling position, in view of reduced silver coverage. Couplers can be employed in the present invention which form a dye of controlled image smearing or a colorless compound, as well as DIR couplers which release a development inhibiting reagent upon coupling reaction, and couplers releasing a development accelerating agent.

Representative examples of yellow couplers useful in this invention include couplers of the "oil-protected" (hydrophobically ballasted) acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in Japanese Patent Publication No. 10739/1983, U.S. Pat. Nos. 4,401,752 and 4,326,024, *Research Disclosure* No. 18053 (April 1979), British Pat. No. 1,425,020 and German Pat. (OLS) Nos. 2,219,917, 2,261,361, and 2,433,812. Couplers of the $\alpha$-pivaloyl-acetoanilide type are superior in the fastness of formed dyed particularly on exposure to light, while couplers of the $\alpha$-benzoylacetoanilide type are capable of forming high maximum density.

Magenta couplers useful for this invention include oil-protected couplers of the indazolone or cyanoacetyl type, preferably of the 5-pyrazolone or pyrazoloazole (e.g., pyrazolotriazole) type. 5-Pyrazolones substituted by an arylamino or acylamino group at the 3-position are preferable in view of the hue and maximum densities of formed dyes, and are illustrated in U.S. Pat. Nos.

2,311,082, 2,343,703, 2,600,788, 2,908,573, 3,062,653, 3,152,896 and 3,936,015.

Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Pat. No. 73,636 have effects to enhance developed density in the 5-pyrazolone couplers.

Examples of pyrazoloazole couplers include purazolobenzimidazole described in U.S. Pat. No. 3,369,897, more preferably pyrazolo[5,1-c][1,2,4]triazoles described in U.S. Pat. No. 3,725,067, pyrazolotetrazoles described in *Research Disclosure,* No. 24220 (June 1984), and pyrazolopyrazole described in *Research Disclosure,* No. 24230 (June 1984). Imidazo[1,2-b]pyrazoles, described in European Pat. No. 119,741, are preferable, and pyrazolo[1,5-b][1,2,4]triazoles, described in European Pat. No. 119,860, are particularly preferable with respect to the reduced yellow side-absorption and fastness of developed dyes on exposure to light.

The cyan couplers that can be used in this invention include naphthol couplers and phenol couplers of the oil-protected type. An example of a naphthol coupler is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of the phenol couplers are those disclosed in U.S. Pat. Nos. 2,369,929, 2,801,171, 2,772,162, and 2,895,826.

Examples of cyan couplers stable to moisture and heat that can be advantageously used in this invention include phenol cyan couplers having a higher alkyl group than methyl group at the meta position of the phenol nucleus, as disclosed in U.S. Pat. No. 3,772,002, 2,5-diacylamino-substituted phenol cyan couplers disclosed in U.S. Pat. No. 2,772,162, 3,758,308, 4,126,396, 4,334,011, 4,327,173, German Patent (OLS) No. 3,329,729 and Japanese Patent Publication No. 42671/1983, and phenol cyan couplers having a phenylureido group at the 2-position and and acylamino group at the 5-position disclosed in U.S. Pat. Nos. 3,446,622, 4,333,999, 4,451,559, and 4,427,767.

It is possible to improve the grainness by using the color couplers in combination with a coupler which forms a dye having a proper degree of diffusion. A magenta coupler of such type is disclosed in U.S. Pat. No. 4,366,237 and British Pat. No. 2,125,570; and a similar type of yellow, magenta, or cyan coupler is disclosed in European Pat. No. 96,570 and West German Patent Application (OLS) No. 3,234,533.

The dye-forming couplers and the special couplers described above may be dimeric, oligomeric or polymeric. Examples of the polymerized dye-forming couplers are disclosed in U.S. Pat. Nos. 3,451,820 and 4,080,211. Examples of polymerized magenta couplers are disclosed in Bristish Pat. No. 2,102,173 and U.S. Pat. No. 4,367,282.

In order to satisfy the characteristics desired for the photographic materials, various couplers used in the present invention can be employed as a combination of two or more couplers in a light-sensitive layer, or the same compound can be employed in two or more layers.

The couplers of the present invention can be incorporated to photographic materials by the oil-in-water dispersing process. According to the oil-in-water dispersing process, dispersants are first dissolved in a single or mixed solvent of a high-boiling (having a boiling point of 175° C. or higher) organic solvent, or a low-boiling (auxiliary) organic solvent, and then dispersed as fine particles in an aqueous medium, e.g., water or an aqueous gelatine solution in the presence of surface active agents. Examples of the high-boiling organic solvents are described in U.S. Pat. No. 2,322,027. For dispersing, phase reversal of emulsion can be utilized. If necessary, prior to coating, the auxiliary solvent may be removed or reduced by distillation, "noodle" washing, or ultrafiltration.

Examples of the high-boiling organic solvents include phthalic esters (dibutyl phthalate, dicyclohexyl phthalate, di-2-ethylhexyl phthalate, and decyl phthalate, etc.), phosphoric or phosphonic esters (triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate, etc.), benzoic esters (2-ethylhexyl benzoate, dodecylbenzoate, 2-ethylhexyl-p-hydroxy benzoate, etc.), amides (diethyldodecanamide, N-tetradecylpyrrolidone, etc.), alcohols or phenols (isostearyl alcohol, 2,4-di-tert-amylphenol, etc.), aliphatic carboxylic esters (dioctylazelate, glycerol tributyrate, isostearyl lactate, trioctyl citrate, etc.), aniline derivatives (N,N-dibutyl-2-butoxy-5-tert-octylaniline, etc.), and hydrocarbons (paraffin, dodecylbenzene, diisopropylnaphthalene, etc.). The auxiliary solvents are organic solvents having a boiling point higher than about 30° C., preferably from about 50° C. to about 160° C. Examples of these solvents include ethyl acetate, butyl acetate, ethyl propionate, methyl ethyl ketone, cyclohexanone, 2-ethoxyethyl acetate, dimethylformamide, etc.

The steps and effect of the latex dispersion method and the examples of latex for impregnation are described in U.S. Pat. No. 4,199,363, and West German Application (OLS) Nos. 2,541,274 and 2,541,230.

Usually the color couplers are used in an amount of 0.001 to 1 mol per mol of photosensitive silver halides. The preferred amounts of coupler are 0.01 to 0.5 mol for yellow coupler, 0.003 to 0.3 mol for magenta coupler, and 0.002 to 0.3 mol for cyan coupler.

The photographic material which is used in this invention may contain, as a color antifoggant or discoloration inhibitor, a hydroquinone derivative, aminophenol derivative, amine, gallic acid derivative, catechol derivative, ascorbic acid derivative, colorless coupler, or sulfoneamidephenol derivative.

In the photographic material to which the present method is applied, a known fading preventive agent can be used. As representative examples of organic fading preventive agents can be mentioned hydroquinones, 6-hydroxycumarones, 5-hydroxycumarones, spirocumarones, p-alkoxyphenols, hindered phenols including bisphenols, gallic acid derivatives, methylenedioxybenzenes, aminophenols, hindered amines, and ether or ester derivatives of these compounds obtained by silylating or alkylating the phenolic hydroxyl group of these compounds. Further, metal complexes such as (bissalicyclaldoxymate)nickel complex and (bis-N,N-dialkyldithiocarbamate)nickel complexes can be used.

To prevent the yellow dye image from being deteriorated by heat, humidity, or light, compounds having both a hindered amine structure and a hindered phenol structure in the same molecule, as described in U.S. Pat. No. 4,268,593, give good results. To prevent the magenta dye image from being deteriorated, particularly by light, spiroindanes, described in Japanese Patent Application (OPI) No. 159644/1981, and hydroquinone-diether-substituted or monoether-substituted chromans, described in Japanese Patent Application (OPI) No. 89835/1980, give preferable results.

To improve shelf stability and particularly fastness to light of the cyan image, it is preferable to use additionally a benzotriazole type ultraviolet absorbent. This ultraviolet absorbent may be co-emulsified with a cyan coupler.

The coating amount of the ultraviolet absorbent may be of such an amount to provide the cyan dye image with light stability, but not too high since it sometimes causes the unexposed part (white background) of the color photographic material to become yellow. The coating amount is generally be set in the range of $1\times10^{-4}$ mol/m$^2$ to $2\times10^{-3}$ mol/m$^2$, more preferably $5\times10^{-4}$ mol/m$^2$ to $1.5\times10^{-3}$ mol/m$^2$.

In the photosensitive layer structure of a usual color paper, one, preferably both, of the opposite layers adjacent to a cyan coupler-containing the red-sensitive emulsion layer contains an ultraviolet absorbent. When an ultraviolet absorbent is added to an intermediate layer between a green-sensitive layer and a red-sensitive layer, it may be co-emulsified with a color mixing preventive agent. When an ultraviolet absorbent is added to a protective layer, another protective layer, as an outermost layer, may be applied. In this protective layer, a matting agent having an arbitrary particle diameter may be included.

In the photographic material to which the present invention is applied, an ultraviolet absorbent can be added to a hydrophilic colloid layer.

In the photographic material to which the present invention is applied, to prevent irradiation or halation or for other purposes, a water-soluble dye may be included as a filter dye in a hydrophilic colloid layer. Oxanole dyes, anthraquinone dyes or azo dyes are preferably used in this regard. Oxonole dyes that absorb green light and red light are particularly preferable.

The photographic emulsion layer or other hydrophilic colloid layers of the photographic material to which the present invention will be applied may contain such a brightening agent as stilbene, triazine, oxazole, or cumarin series. Water-soluble brightening agents may be used, or water-insoluble brightening agents in the form of a dispersion may be used.

As described above, the present invention can be applied to a multi-layer, multi-color photographic material having at least two different spectral sensitivities on a base. Generally, a multi-layer color photographic material has at least one red-sensitive emulsion layer, at least one green-sensitive emulsion layer, and at least one blue-sensitive emulsion layer on a base. The order of the arrangement of these layers may be selected arbitrarily as desired. Each of these emulsion layers may be composed of two or more emulsion layers, and a non-photosensitive layer may be present between two or more emulsion layers having the same sensitivity.

It is preferable that the photographic material to which the present invention will be applied has arbitrarily, in addition to a silver halide emulsion layer, auxiliary layers, such as a protective layer, an intermediate layer, a filter layer, an antihalation layer, and a backing layer.

As a binder or a protective colloid that can be used in the emulsion layer and the intermediate layer of the photographic material to which the present invention will be applied, gelatin is advantageously used, but other hydrophilic colloids can be used.

For example, proteins such as gelatin derivatives, graft polymers of gelatin with other polymers, albumin and casein; cellulose derivatives such as hydroxyethylcelluloses, carboxymethylcelluloses and cellulose sulfates; saccharide derivatives such as sodium alginate and starch derivatives; and various synthetic hydrophilic polymers such as homopolymers or copolymers, for example, polyvinyl alcohol, polyvinyl alcohol partially changed to acetal, poly-N-vinylpyrrolidone, polyacrylic acid, polymethacrylic acid, polyacrylamide, polyvinylimidazole, and polyvinylpyrazole can be used. It is particularly useful to use acrylic acid-modified polyvinyl alcohol in a protective layer, which is further useful when an emulsion having a high silver halide content and rapid processing are used.

As gelatin, use can be made, in addition to lime-processed gelatin, of acid-treated gelatins and enzyme-treated gelatin as described in "Bull. Soc. Sci. Phot. Japan". No. 16, page 30 (1966). Hydrolyzates and enzymes decomposition product of gelatin can also be used.

To the photographic material to which the present invention will be applied may be added, in addition to the above additives, various stabilizers, stain preventatives, developers or their precursors, the above-mentioned development accelerators and their precursors, lubricants, mordants, matting agents, antistatic agents, and plasticizers or other additives useful to photographic materials. Typical examples of these additives are described in *Research Disclosure,* 17643 (December 1978), and *Research Disclosure,* 18716 (November 1979).

These additives are very important with regard to rapid printing, rapid processing, and important with respect to compounds (I) according to the present invention. In particular, when the halogen composition of an emulsion which is used has a high silver halide content, the additional use of a mercaptotriazole compound, a mercaptothiazole compound, or a mercaptobenzazole compound is useful in the present invention, in view of color forming property and the occurrence of fogging.

The "reflective base" that can be used in the photographic material to which the present invention will be applied increases the reflectivity and makes clear the dye image formed in a silver halide emulsion layer, and such a reflective base includes a base coated with a hydrophobic resin containing a light reflecting material dispersed therein such as titanium oxide, zinc oxide, calcium carbonate and calcium sulfate. For example, baryta paper, polyethylene-coated paper, polypropylene synthetic paper, a transparent base (e.g., glass plate, film of polyesters such as polyethylene terephthalate, cellulose triacetate and cellulose nitrate, polyamide film, polycarbonate film, and polystyrene film) having a reflective layer or a reflecting material can be suitably selected according to the application.

The present developer composition for a silver halide color photographic material can provide a color developer that is excellent in stability and color forming property, and is distinguished in that the increase in fogging, for example in continuous processing, is remarkably lowered.

The effect of the color developer in the present invention is further increased when it is used in a system substantially free of benzyl alcohol.

When the present developer composition is used in the color developer, the stability can be increased and the color forming property can be prevented from being deteriorated without using a substance such as a sulfite ion that acts as a competing compound with a developing agent.

Now, the present invention will be described in detail in accordance with examples, but the latter do not intend to limit the scope of the present invention.

EXAMPLE 1

On each paper base which had been laminated on both the surfaces with a polyethylene, a multi-layer color photographic paper was formed. Coating solutions which were used above were prepared as follows:

Preparation of the First Layer Coating Solution then dissolved. Afterward, the resulting solution was emulsified and dispersed in 185 ml of a 10% aqueous gelatin solution containing 8 ml of 10% sodium dodecylbenzenesulfonate. On the other hand, the undermentioned blue-sensitive sensitizing dye was added to a silver chlorobromide emulsion (containing 1.0 mol% of silver bromide and 70 g/kg of Ag), the amount being $5.0\times10^{-4}$ mol per mol of silver chlorobromide, so that 90 g of a blue-sensitive emulsion was prepared. This blue-sensitive emulsion was mixed with and dissolved in the above emulsified and dispersed solution, and a concentration of gelatin was adjusted so as to obtain the composition shown in Table B, thereby constituting the desired first coating solution.

The second to seventh layer coating solutions were prepared in the same manner as the first. As a gelatin hardening agent for the respective layers, 1-oxy-3,5-dichloro-s-triadine sodium salt was used.

Further, as spectral sensitizers for the respective emulsions, the following materials were used.

Blue-sensitive emulsion layer

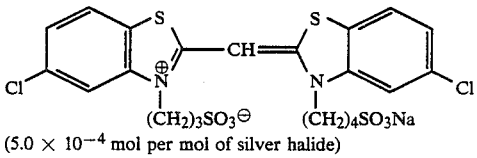

($5.0\times10^{-4}$ mol per mol of silver halide)

Green-sensitive emulsion layer

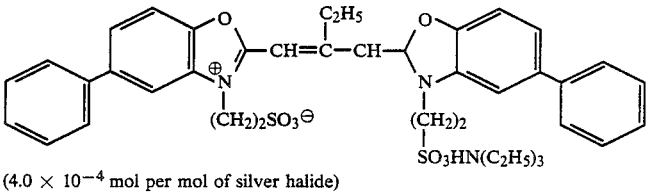

($4.0\times10^{-4}$ mol per mol of silver halide)

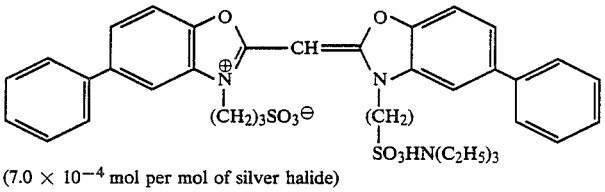

($7.0\times10^{-4}$ mol per mol of silver halide)

Red-sensitive emulsion layer

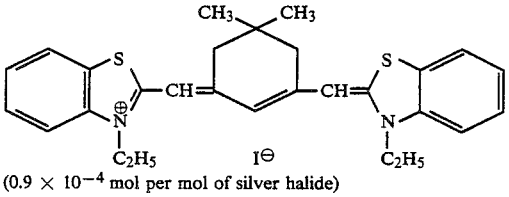

($0.9\times10^{-4}$ mol per mol of silver halide)

To a mixture of 19.1 g of a yellow coupler (a) and 4.4 g of a image dye stabilizer (b) were added 27.2 ml of ethyl acetate and 7.9 ml of a solvent (c), and they were The following dyes were used to prevent the respective emulsion layers from irradiation.

Green-sensitive emulsion layer

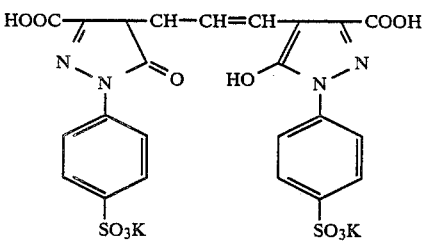

-continued
Red-sensitive emulsion layer
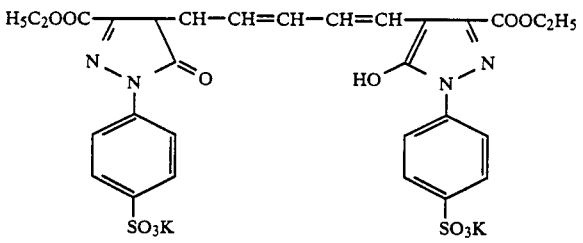
The following compounds (e.g., a coupler) were used in this Example.
(a) Yellow coupler
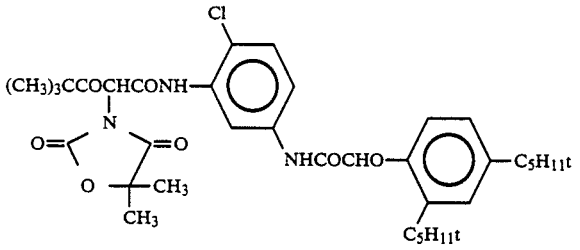
(b) Image dye stabilizer
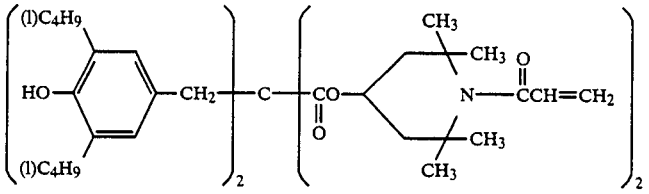
(c) Solvent
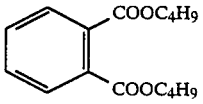
(d) Color mix inhibitor
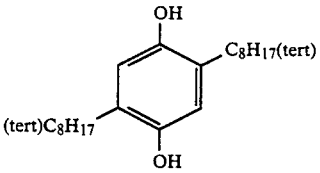
(e) Solvent
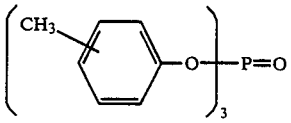
(f) Image dye stabilizer
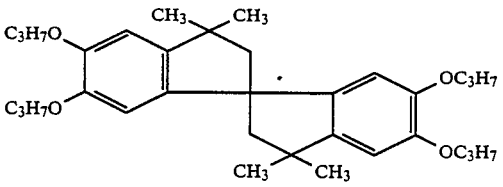
(g) Solvent
$(C_8H_{17}O)_3-P=O$ and (
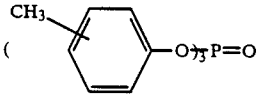
(mixture in weight ratio of 2:1)

-continued
(h) UV Absorbent
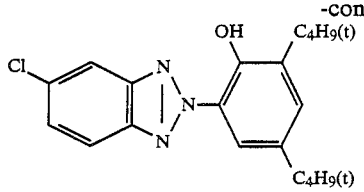
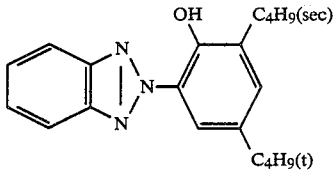
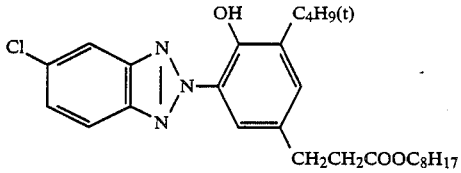
(mixture in mole ratio of 1:5:3)
(k) Cyan coupler
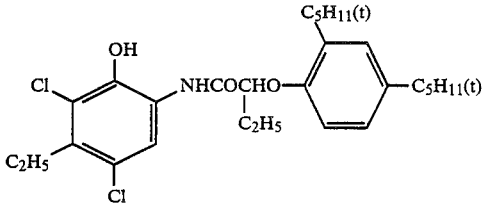
($k_1$)
and
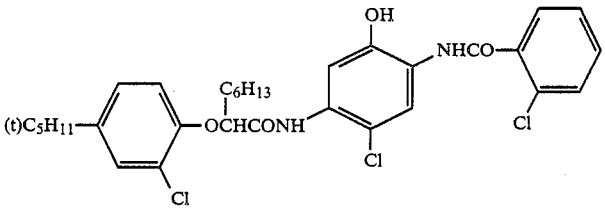
($k_2$)
(mixture in mole ratio of 1:1)
(l) Image dye stabilizer
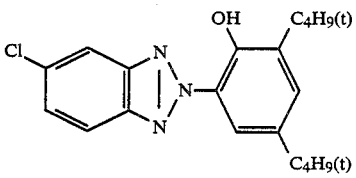
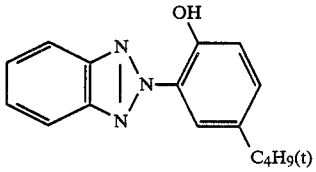
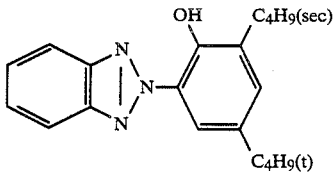

-continued (mixture in mole ratio of 1:3:3)

(m) Magenta coupler

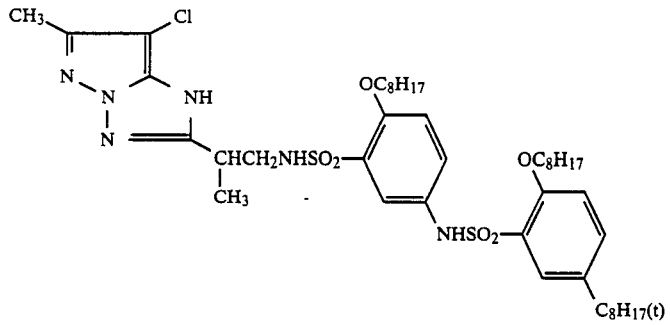

TABLE B

| Layer | Main Component | | |
|---|---|---|---|
| Seventh Layer (protective layer) | Gelatin | 1.33 | g/m$^2$ |
| | Acryl-Modified Copolymer of Polyvinyl alcohol (modification degree 17%) | 0.17 | " |
| Sixth Layer (UV ray absorbing layer) | Gelatin | 0.54 | g/m$^2$ |
| | UV Absorbent (h) | 0.21 | " |
| | Solvent (j) | 0.09 | cc/m$^2$ |
| Fifth Layer (red-sensitive emulsion layer) | Silver Chlorobromide Emulsion (silver bromide 1 mol %) Silver: | 0.26 | g/m$^2$ |
| | Gelatin | 0.98 | " |
| | Cyan Coupler (k) | 0.38 | " |
| | Image Dye Stabilizer (l) | 0.17 | " |
| | Solvent (e) | 0.23 | cc/m$^2$ |
| Fourth Layer (UV absorbing layer) | Gelatin | 1.60 | g/m$^2$ |
| | UV Absorbent (h) | 0.62 | " |
| | Color Mix Inhibitor (i) | 0.05 | " |
| | Solvent (j) | 0.26 | cc/m$^2$ |
| Third Layer (green-sensitive) emulsion layer) | Silver Chlorobromide Emulsion (silver bromide 0.5 mol %) Silver: | 0.16 | g/m$^2$ |
| | Gelatin | 1.80 | " |
| | Magenta Coupler (m) | 0.34 | " |
| | Image Dye Stabilizer (f) | 0.20 | " |
| | Solvent (g) | 0.68 | cc/m$^2$ |
| Second Layer (color mix preventing layer) | Gelatin | 0.99 | g/m$^2$ |
| | Color Mix Inhibitor (d) | 0.08 | " |
| First Layer (blue-sensitive emulsion layer) | Silver Chlorobromide Emulsion (silver bromide 1 mol %) Silver: | 0.30 | g/m$^2$ |
| | Gelatin | 1.86 | " |
| | Yellow Coupler (a) | 0.82 | " |
| | Image Dye Stabilizer (b) | 0.19 | " |
| | Solvent (c) | 0.34 | cc/m$^2$ |
| Base | Polyethylene Laminate Paper [a white pigment ($TiO_2$) and a bluish dye (ultramarine) were included in the first layer side] | | |

The color photographic papers thus formed were subjected to an exposure through an optical wedge, and afterward to the following processing.

| Processing steps | Temperature | Time |
|---|---|---|
| Color Development | 35° C. | 45 sec |
| Bleach-Fix | 35° C. | 45 sec |
| Rinsing 1 | 35° C. | 20 sec |
| Rinsing 2 | 35° C. | 20 sec |
| Rinsing 3 | 35° C. | 20 sec |
| Drying | 80° C. | 60 sec |

Here, the following solutions were used.

| Color Developer | |
|---|---|
| N,N—Diethylhydroxylamine | 4 g |
| Potassium carbonate | 30 g |
| EDTA.2Na.2$H_2O$ | 2 g |
| Sodium chloride | 1.0 g |
| 4-Amino-3-methyl-N—ethyl-N—(β-(methanesulfonamido)ethyl)-p-phenylenediamine sulfate | 5.0 g |
| Brightening agent (4,4'-diaminostilbene series) | 3.0 g |
| Compound of Formula (I) | in Table 1 |

-continued

| | |
|---|---|
| Water | q.s. to 1,000 ml |
| (pH 10.10) | |
| Bleach-Fix Solution | |
| EDTA.Fe (III).$NH_4$.2$H_2O$ | 60 g |
| EDTA.2Na.2$H_2O$ | 4 g |
| Ammonium thiosulfate (70%) | 120 ml |
| Sodium sulfite | 16 g |
| Glacial acetic acid | 7 g |
| Water | q.s. to 1,000 ml |
| (pH 5.5) | |
| Rinsing Solution | |
| 1-Hydroxyethylidene-1,1'-diphosphonic acid (60%) | 1.6 ml |
| Bismuth chloride | 0.35 g |
| Polyvinylpyrrolidone | 0.25 g |
| Aqueous ammonia (26%) | 2.5 ml |
| Nitrilotriacetic acid.3Na | 1.0 g |
| EDTA.4H | 0.5 g |
| Sodium sulfite | 1.0 g |
| 5-Chloro-2-methyl-4-isothiazoline-3-one | 50 mg |
| Formalin (37%) | 0.1 ml |
| Water | q.s. to 1,000 ml |
| (pH 7.0) | |

A part of the color developers thus obtained was allowed to stand at 40° C. for 20 days in an open system in a 1-l beaker, and the above-mentioned process was then repeated.

The processing by the use of the color developers was called a stood solution test, and the processing by the use of the color developers which did not undergo the standing step would be called a fresh solution test.

Photographic properties obtained by the fresh solution tests and the stood solution tests are set forth in Table 1.

The photographic properties are evaluated from the three viewpoints of Dmin, sensitivity and gradation at a yellow density.

The sensitivity was represented with a density of a certain exposure (100 CMS), and the gradation was estimated by a density change within the range of density point of 0.5 to another density point corresponding to the higher exposure side by 0.3 in terms of log E.

According to this invention, the photographic properties scarcely change, even when the developers are stored in the open system for a long period of time, therefore demonstrating stable performance. To the contrary, when sodium sulfite and triethanolamine are used, changes occur with time: fogging appears on the photographic images, and the gradation becomes altered.

TABLE 1

| Experiment No. | Added compound | (mol/l) | | Fresh solution D min | Fresh solution Sensitivity | Fresh solution Gradation | Stood solution (stood at 40° C. for 20 days) D min | Stood solution Sensitivity | Stood solution Gradation |
|---|---|---|---|---|---|---|---|---|---|
| 1 | — | | Comparative example | 0.11 | 0.62 | 0.72 | 0.18 | 0.61 | 0.80 |
| 2 | Sodium sulfite | $1.5 \times 10^{-2}$ | Comparative example | 0.11 | 0.58 | 0.65 | 0.13 | 0.60 | 0.69 |
| 3 | Triethanolamine | $7 \times 10^{-2}$ | Comparative example | 0.11 | 0.63 | 0.71 | 0.15 | 0.65 | 0.76 |
| 4 | I-(1) | " | This invention | 0.11 | 0.63 | 0.72 | 0.11 | 0.64 | 0.73 |
| 5 | (4) | " | This invention | 0.11 | 0.62 | 0.73 | 0.11 | 0.62 | 0.73 |
| 6 | (6) | " | This invention | 0.11 | 0.62 | 0.72 | 0.11 | 0.63 | 0.73 |
| 7 | (13) | " | This invention | 0.11 | 0.62 | 0.72 | 0.12 | 0.63 | 0.73 |
| 8 | (15) | " | This invention | 0.11 | 0.63 | 0.73 | 0.12 | 0.63 | 0.72 |
| 10 | (22) | " | This invention | 0.11 | 0.63 | 0.73 | 0.12 | 0.63 | 0.72 |
| 11 | (24) | " | This invention | 0.11 | 0.62 | 0.72 | 0.12 | 0.62 | 0.72 |

EXAMPLE 2

As described in Table C, each paper, both surfaces of which had been laminated with a polyethylene and which had been subjected to a corona discharge processing, was coated with a first layer (lowermost layer) to a seventh layer (uppermost layer) to prepare samples.

A coating solution of the above-mentioned first layer was prepared as follows: A mixture of 200 g of a yellow coupler, 93.3 g of a discoloration inhibitor, 10 g of a high boiling point solvent (p), 5 g of a similar solvent (q) and 600 ml of ethyl acetate as an auxiliary solvent was heated to 60° C., thereby dissolving the respective components. The mixture was further mixed with 3,300 ml of a 5% aqueous gelatin solution containing 330 ml of a 5% aqueous Alkanol B (tradename, alkyl naphthalenesulfonate; made by Du Pont) solution, and emulsification was carried out using a colloid mill to form a coupler dispersion. From this dispersion, ethyl acetate was distilled off under reduced pressure, and the acetate was then added to 1,400 g of an emulsion (containing 96.7 g of Ag and 170 g of gelatin) to which there were added a sensitizing dye for a blue-sensitive emulsion layer, and 1-methyl-2-mercapto-5-acetylamino-1,3,4-triazole. Further, 2,600 g of a 10% aqueous gelatin solution was added thereto to prepare the desired coating solution. The second to seventh layers were prepared in the same manner as the first.

TABLE C

| Layer | Main Component | |
|---|---|---|
| Seventh Layer (protective layer) | Gelatain | 600 mg/m$^2$ |
| Sixth Layer (UV absorbing layer) | UV Absorbent (n) | 260 mg/m$^2$ |
| | UV Absorbent (o) | 70 mg/m$^2$ |
| | Solvent (p) | 300 mg/m$^2$ |
| | Solvent (q) | 100 mg/m$^2$ |
| | Gelatin | 700 mg/m$^2$ |
| Fifth Layer (red-sensitive layer) | Silver Chlorobromide Emulsion (silver bromide 1 mol %) | 210 mg/m$^2$ |
| | Cyan Coupler (C-2) | 260 mg/m$^2$ |
| | Cyan Coupler (C-1) | 120 mg/m$^2$ |
| | Discoloration Inhibitor (r) | 250 mg/m$^2$ |
| | Solvent (p) | 160 mg/m$^2$ |
| | Solvent (q) | 100 mg/m$^2$ |
| | Gelatin | 1800 mg/m$^2$ |
| Fourth Layer (color mix inhibiting | Color Mix Inhibitor (s) | 65 mg/m$^2$ |
| | UV Absorbent (n) | 450 mg/m$^2$ |

TABLE C-continued

| Layer | Main Component | |
|---|---|---|
| layer) | UV Absorbent (o) | 230 mg/m$^2$ |
| | Solvent (p) | 50 mg/m$^2$ |
| | Solvent (q) | 50 mg/m$^2$ |
| | Gelatin | 1700 mg/m$^2$ |
| Third Layer (green-sensitive layer) | Silver Chlorobromide Emulsion (silver bromide 3 mol %) | 305 mg/m$^2$ |
| | Magenta Coupler | 670 mg/m$^2$ |
| | Discoloration Inhibitor (t) | 150 mg/m$^2$ |
| | Discoloration Inhibitor (u) | 10 mg/m$^2$ |
| | Solvent (p) | 200 mg/m$^2$ |
| | Solvent (q) | 10 mg/m$^2$ |
| | Gelatin | 1400 mg/m$^2$ |
| Second Layer (discoloration inhibiting layer) | Silver Bromide Emulsion (no after-ripening, grain diameter 0.05 microns) Silver | 10 mg/m$^2$ |
| | Discoloration Inhibitor (s) | 55 mg/m$^2$ |
| | Solvent (p) | 30 mg/m$^2$ |
| | Solvent (q) | 15 mg/m$^2$ |
| | Gelatin | 800 mg/m$^2$ |
| First Layer (blue-sensitive layer) | Silver chlorobromide Emulsion (silver bromide 5 mol %) | 290 mg/m$^2$ |
| | Yellow Coupler | 600 mg/m$^2$ |
| | Discoloration Inhibitor (r) | 280 mg/m$^2$ |
| | Solvent (p) | 30 mg/m$^2$ |
| | Solvent (q) | 15 mg/m$^2$ |
| | Gelatin | 1800 mg/m$^2$ |
| Base | Paper, both surfaces of which were laminated with polyethylene | |

(n) 2-(2-hydroxy-3,5-di-tert-amylphenyl)benzotriazole
(o) 2-(2-hydroxy-3,5-di-tert-butylphenyl)benzotriazole
(p) di(2-ethylhexyl)phthalate
(q) dibutyl phthalate
(r) 2,5-di-tert-amylphenyl-3,5-di-tert-butylhydroxybenzoate
(s) 2,5-di-tert-octylhydroquinone
(t) 1,4-di-tert-amyl-2,5-dioctyloxybenzene
(u) 2,2'-methylenebis(4-methyl-6-tert-butylphenol).

Further, as sensitizing dyes for the respective emulsion layers, the following materials were used. For the blue-sensitive emulsion layer: anhydro-5-methoxy-5-methyl-3,3'-disulfopropylselenacyanine hydroxide. For the green-sensitive emulsion layer: anhydro-9-ethyl-5,5'-diphenyl-3,3'-disulfoethyloxacarbocyanine hydroxide. For the red-sensitive emulsion layer: 3,3'-diethyl-5-methoxy-9,9'-(2,2-dimethyl-1,3-propano)thiazicarbocyanine iodide.

Further, as a stabilizer for the respective emulsion layers, 1-methyl-2-mercapto-5-acetylamino-1,3,4-triazole was used.

Furthermore, as irradiation inhibiting dyes, the following materials were used:

4-(3-carboxy-5-hydroxy-4-(3-(3-carboxy-5-oxo-1-(4-sulfonatophenyl)-2-pyrazoline-4-iridene)-1-propenyl)-1-pyrazolyl)benzenesulfonate-di-potassium salt and N,N'-(4,8-dihydroxy-9,10-dioxo-3,7-disulfonatoanthracene-1,5-diyl)bis(aminomethanesulfonate)-tetrasodium salt.

Moreover, as a hardening agent, 1,2-bis(vinylsulfonyl)ethane was used.

Here, the following couplers were used.

Yellow coupler

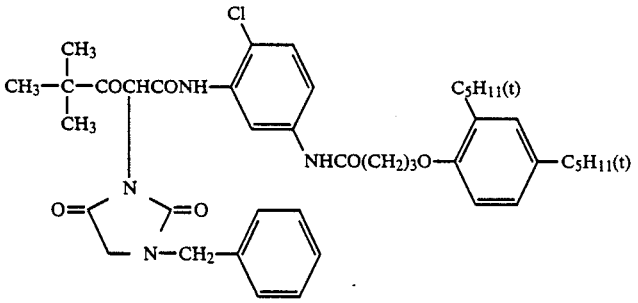

Magenta coupler

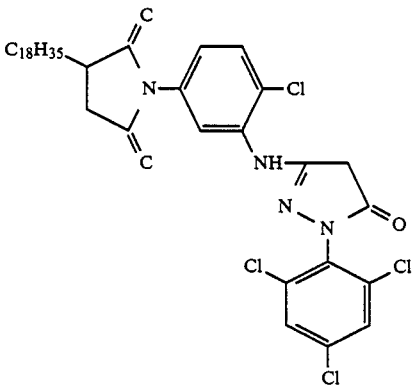

Cyan coupler (mixture in mole ratio of C-1:C-2 = 50:50)

-continued

C-1

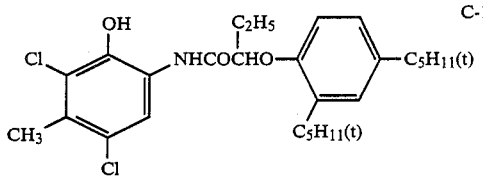

C-2

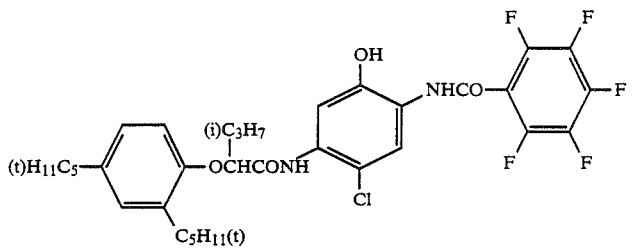

The multi-layer color photographic papers thus obtained were subjected to an exposure through an optical wedge, and then the following process.

| Processing steps | Time | Temperature |
|---|---|---|
| Color Development | 3 min 30 sec | 33° C. |
| Bleach-Fix | 1 min 30 sec | 33° C. |
| Rinsing (3 tank cascade) | 3 min | 30° C. |
| Drying | 1 min | 80° C. |

Here, the following processing solutions were used.

| Color Developer | |
|---|---|
| Water | 800 ml |
| Benzyl alcohol | in Table 2 |
| Diethylene glycol | in Table 2 |
| Diethylenetriaminepentaacetic acid | 1.0 g |
| N,N'—Bis(2-hydroxybenzyl)ethylenediamine-N,N'—diacetic acid | 0.1 g |
| Nitrilo-N,N,N—trimethylenephosphonic acid (40%) | 1.0 g |
| Potassium bromide | 1.0 g |
| Compound of general formula (I) | in Table 2 |
| Hydroxylamine | in Table 2 |
| Potassium carbonate | 30 g |
| N—Ethyl-N—(β-methanesulfoneamidoethyl)-3-methyl-4-aminoaniline sulfate | 5.5 g |
| Brightening agent (4,4'-diaminostilbene series) | 1.0 g |
| Water | q.s. to 1,000 ml |
| with KOH | pH 10.10 |

-continued

| Bleach-Fix Solution | |
|---|---|
| Ammonium thiosulfate (70%) | 150 ml |
| Sodium sulfite | 15 g |
| Ethylenediamine iron (III) ammonium | 60 g |
| Ethylenediaminetetraacetic acid | 10 g |
| Brightening agent (4,4'-diaminostilbene series) | 1.0 g |
| 2-Mercapto-5-amino-3,4-thiazole | 1.0 g |
| Water | q.s. to 1,000 ml |
| with Aqueous ammonia | pH 7.0 |
| **Rinsing Solution** | |
| 5-Chloro-2-methyl-4-isothiazoline-3-one | 40 mg |
| 2-Methyl-4-isothiazoline-3-one | 10 mg |
| 2-Octyl-4-isothiazoline-3-one | 10 mg |
| Bismuth chloride (40%) | 0.5 g |
| Nitrilo-N,N,N—trimethylenephosphonic acid (40%) | 1.0 g |
| 1-Hydroxyethylindene-1,1-diphosphonic acid (60%) | 2.5 g |
| Brightening agent (4,4'-diaminostilbene series) | 1.0 g |
| Aqueous ammonia (26%) | 2.0 ml |
| Water | q.s. to 1,000 ml |
| with KOH | pH 7.5 |

In the same manner as in Example 1, Dmin, sensitivity and gradation of magenta in the fresh solutions and the preserved solutions were measured, and changes of photographic performance on the basis of photographic properties of the fresh solution were additionally sought. The results are set forth in Table 2.

TABLE 2

| Experiment No. | Benzyl alcohol (ml/l)/Diethylene glycol (ml/l) | Hydroxylamine Compound (0.04 mol/l) | Compound of general formula (I) (0.1 mol/l) | | Changes of photographic performance by stood solution | | |
|---|---|---|---|---|---|---|---|
| | | | | | D min | Sensitivity | Gradation |
| 12 | 15/10 | — | — | Comparative example | +0.21 | +0.23 | +0.13 |
| 13 | " | II-(5) | — | Comparative example | +0.10 | +0.10 | +0.06 |
| 14 | " | II-(34) | Hydroxylamine | Comparative example | +0.10 | +0.06 | +0.08 |
| 15 | " | — | I-(13) | Comparative example | +0.05 | +0.04 | +0.03 |
| 16 | " | II-(33) | I-(13) | | +0.03 | +0.03 | +0.02 |
| 17 | " | II-(5) | I-(13) | This invention | +0.02 | +0.02 | +0.01 |
| 18 | " | II-(5) | I-(15) | | +0.02 | +0.02 | +0.01 |
| 19 | — | II-(5) | — | Comparative example | +0.08 | +0.08 | +0.06 |
| 20 | — | II-(34) | Hydroxylamine | Comparative example | +0.09 | +0.06 | +0.07 |
| 21 | — | — | I-(13) | Comparative | +0.02 | +0.02 | +0.01 |
| 22 | — | II-(33) | I-(13) | | +0.01 | +0.01 | +0.01 |
| 23 | — | II-(5) | I-(13) | This invention | +0.01 | +0.01 | 0 |
| 24 | — | II-(33) | I-(15) | | +0.01 | +0.01 | +0.01 |
| 25 | — | II-(5) | I-(15) | " | 0 | 0 | 0 |
| 28 | — | II-(33) | I-(22) | " | +0.01 | +0.02 | +0.02 |
| 29 | — | II-(5) | I-(22) | " | +0.01 | +0.01 | +0.02 |

The results in the above table indicate that the developer compositions of this invention have an excellent effect in the system containing benzyl alcohol, and in particular, when they are used in the system containing no benzyl alcohol, their photographic properties are remarkably stabilized (see Experiment Nos. 15, 16, 17, 18, 21, 22, 23, 24 and 25). On the other hand, when hydroxylamine is used alone, the preserved solution changes with time, and the change in the photographic properties is great.

EXAMPLE 3

The procedure of Example 2 was repeated with the exception that, to form photographic papers, the silver halide emulsion composition for the third layer of each sample of photographic paper was 80 mol% of silver bromide. The latter were then stored in the same manner as in Experiment Nos. 12 to 25 in Example 2, and afterward the changes in photographic properties were measured. The results make it apparent that when hydroxylamine is used alone, the photographic properties of the preserved solutions change noticeably with time, as in Example 2, but the developer compositions of this invention show a remarkable stability, particularly in the system containing no benzyl alcohol.

EXAMPLE 4

Color photographic papers were prepared in the same manner as described in Example 1. The thus formed photographic papers were subjected to an exposure through an optical wedge and then to a test of running (continuous) processing employing the color developer composition of this invention, until the replenisher amount reaches as much as three times of the tank volume.

| Processing steps | Temperature | Time | Replenisher amount |
|---|---|---|---|
| Color Development | 35° C. | 45 sec | 160 ml/m$^2$ |
| Bleach-Fix | 35° C. | 45 sec | 100 ml/m$^2$ |
| Rinsing 1 | 30° C. | 20 sec | |
| Rinsing 2 | 30° C. | 20 sec | |
| Rinsing 3 | 30° C. | 20 sec | 200 ml/m$^2$ |
| Drying | 60–70° C. | 30 sec | |

Rinsings were carried by a three tank counterflow mode from rinsing 3 to rinsing 1.

The following processing solutions were used.

| Color Developer | Tank solution | Replenisher |
|---|---|---|
| Compound of Formula (I) I-(13) | 0.03 mol | 0.03 mol |
| Hydroxylamine II-(5) | 0.04 mol | 0.04 mol |
| Brightening agent (4,4'-diaminostilbene series) | 3.0 g | 4.0 g |
| EDTA | 1.0 g | 1.5 g |
| Potassium carbonate | 30.0 g | 30.0 g |
| Sodium chloride | 1.4 g | 0.1 g |
| 4-Amino-3-methyl-N—ethyl-N—(β-(methanesulfonamido)-ethyl)-p-phenylenediamine sulfate | 5.0 g | 7.0 g |
| Benzyl alcohol | 15 ml | 20 ml |
| Diethylene glycol | 10 ml | 10 ml |
| 1,2-Dihydroxybenzene-3,4,6-trisulfonate | 300 mg | 300 mg |
| Water | q.s. to 1,000 ml | q.s. to 1,000 ml |
| pH | 10.10 | 10.50 |

-continued

| Bleach-Fix Solution | |
|---|---|
| EDTA.Fe (III).$NH_4$.$2H_2O$ | 60 g |
| EDTA.2Na.$2h_2O$ | 4 g |
| Ammonium thiosulfate (70%) | 120 ml |
| Sodium bisulfite | 16 g |
| Glacial acetic acid | 7 g |
| Water | q.s. to 1,000 ml |
| pH | 5.5 |

Rinsing Solution

Tap water was treatd by passing through a hybrid type column filled with a H-type strong acidic cation-exchange resin (Diaion SK-1B, tradename, made by Mitsubishi Chemical Industries Ltd.) and a OH type strong alkaline anion-exchange resin (Diaion SA-10A, tradename, made by Mitsubishi Chemical Industries Ltd.) to obtain a water as shown below. To the thus treated water 20 mg/l of sodium dichloroisocyanurate was added as a bactericide.

| | |
|---|---|
| Calcium ion | 1.1 mg/l |
| Magnesium ion | 0.5 mg/l |
| pH | 6.9 |

Photographic papers were processed using the above processing solutions, and B. G. and R. densities at the unexposed portion were measured using Fuji-mode autographic recording densitometer at both the beginning of the running processing and the end of the running processing. Further the sample obtained at the end of the running processing was preserved at 80° C. (5~10% RH) for one month, and then B. G. and R. densities at the unexposed portion were measured.

As a result, it was evident that in comparison with the start of the running processing the stain scarcely increased at the end of running processing and that increase of stain with time was very small according to the preservation test.

Having described our invention as related to the embodiment, it is our intention that the invention not be limited by any of the details of the description, unless otherwise specified, but rather be construed broadly within the spirit and scope set out in the accompanying claims.

What we claim is:

1. A method for processing a silver halide color photographic material having a color coupler associated therewith, which comprises processing the silver halide color photographic material which has been imagewise exposed to light with a color developer containing (i) an aromatic primary amine color developing agent, (ii) a compound represented by formula (I-1) or (I-2), and (iii) a hydroxylamine compound represented by formula (II):

Formula (I-1)

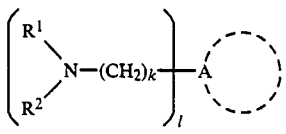

-continued

Formula (I-2)

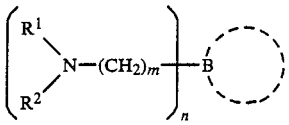

wherein $R^1$ and $R^2$, which may be the same or different, each represents a hydrogen atom, or a substituted or unsubstituted alkyl group, aryl group or heterocyclic group;

A and B are an organic group composed of atoms selected from the group consisting of carbon, oxygen, nitrogen and sulfur atoms, and each represents a saturated and unsaturated 5- to 6-membered ring, respectively, and each may contain a fused benzene ring or a fused heterocyclic ring;

k and m are integers of 1 to 6, l and n are integers of 1 to 3, provided that m+n is 3 or greater; and Formula (II)

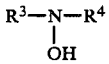

wherein $R^3$ and $R^4$, which may be the same or different, each represents a substituted or an unsubstituted alkyl group or alkenyl group.

2. The method for processing as claimed in claim 1, wherein $R^1$ or $R^2$ has a substituent selected from the group consisting a a hydroxyl group, an alkoxy group, an acyloxy group, an acylamino group, a sulfonylamino group, an alkoxycarbonyl group, an amino group, an alkylsubstituted amino group, a cyano group, a nitro group, a halogen atom, a sulfo group, a ureido group, a carbamoyl group, and a sulfamoyl group, having 0~10 carbon atoms therein.

3. The method for processing as claimed in claim 1, wherein $R^1$ and $R^2$ represent an alkyl group having 1~4 carbon atoms, an aryl group having 6~10 carbon atoms and 5~6-membered heterocyclic group having oxygen, nitrogen or sulfur atoms therein.

4. The method for processing as claimed in claim 3, wherein the alkyl group has a hydrophilic functional group as a substituent.

5. The method for processing as claimed in claim 1, wherein the color developer is substantially free of benzyl alcohol.

6. The method for processing as claimed in claim 1, wherein the compound represented by formula (I-1) or (I-2) is added in an amount of 0.01~50 g per liter of the color developer.

7. The method for processing as claimed in claim 1, wherein $R^3$ and $R^4$ have 1~10 carbon atoms.

8. The method for processing as claimed in claim 1, wherein the compound represented by formula (II) is added in an amount of 0.1~20 g per liter of the color developer.

9. The method for processing as claimed in claim 1, wherein the silver halide color photographic material is processed by continuous processing.

10. The method for processing as claimed in claim 1, wherein $R^3$ and $R^4$ are each independently an alkyl group having 1 to 10 carbon atoms or an alkenyl group having 2 to 10 carbon atoms.

11. The method for processing as claimed in claim 1, wherein $R^3$ and $R^4$ may form a heterocyclic ring through a nitrogen atom.

12. The method for processing as claimed in claim 1, wherein the alkyl group and the alkenyl group may be straight-, branched-chain, or cyclic, and the substituents thereof are selected from the group consisting of a halogen atom, an aryl group, an alkoxy group, an aryloxy group, a sulfonyl group, a sulfonamido group, a sulfamoyl group, a carbamoyl group, an amido group, a ureido group, an alkoxycarbonylamino group, an aryloxycarbonylamino group, an alkoxycarbonyl group, an aryloxycarbonyl group, a cyano group, a hydroxy group, a carboxy group, a sulfo group, a nitro group, an amino group, an alkylthio group, an arylithio group and a heterocyclic group.

13. The method for processing as claimed in claim 11, wherein the nitrogen-containing heterocyclic rings that may be formed by $R^3$ and $R^4$ are selected from the group consisting of a piperidyl group, a pyrrolidyl group, an N-alkylpiperazyl group, a morpholinyl group, an indolinyl group, and a benztriazole group.

14. The method for processing as claimed in claim 1, wherein the substituents of $R^3$ or $R^4$ are selected from the group consisting of a hydroxyl group, an alkoxy group, an alkylsulfonyl group, an arylsulfonyl group, an amido group, a carboxyl group, a cyano group, a sulfo group, a nitro group, and an amino group.

15. A color developer composition for processing a silver halide color photographic material having a color coupler associated therewith, which comprises a color developer in an aqueous alkaline solution containing (i) an aromatic primary amine color developing agent, (ii) a compound represented by formula (I-1) or (I-2), and (iii) a hydroxylamine compound represented by formula (II):

Formula (I-1)

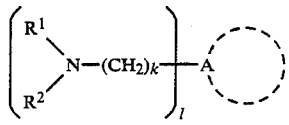

Formula (I-2)

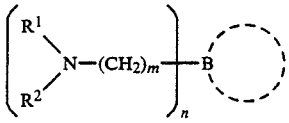

wherein $R^1$ and $R^2$, which may be the same or different, each represents a hydrogen atom, or a substituted or unsubstituted alkyl group, aryl group or heterocyclic group;

A and B are an organic group composed of atoms selected from the group consisting of carbon, oxygen, nitrogen and sulfur atoms, and each represents a saturated and unsaturated 5- to 6-membered ring, respectively, and each may contain a fused benzene ring or a fused heterocyclic ring;

k and m are integers of 1 to 6, l and n are integers of 1 to 3, provided that m+n is 3 or greater; and

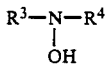

Formula (II)

wherein $R^3$ and $R^4$, which may be the same or different, each represents a substituted or an unsubstituted alkyl group or alkenyl group.

16. The composition as clamed in claim 15, wherein $R^1$ or $R^2$ has a substituent selected from the group consisting of a hydroxyl group, an alkoxy group, an acyloxy group, an acylamino group, a sulfonylamino group, an alkoxycarbonyl group, an amino group, an alkylsubstituted amino group, a cyano group, a nitro group, a halogen atom, a sulfo group, a ureido group, a carbamoyl group, and a sulfamoyl group, having 0~10 carbon atoms therein.

17. The composition as claimed in claim 15, wherein $R^1$ and $R^2$ represent an alkyl group having 1~4 carbon atoms, an aryl group having 6~10 carbon atoms and a 5~6 membered heterocyclic group having oxygen, nitrogen or sulfur atoms therein.

18. The composition as claimed in claim 15, wherein A is a saturated 5- to 6-membered ring selected from the group consisting of cyclohexyl, piperidino, piperidyl, morpholino, oxolanyl, piperazinyl and pyrrolidinyl and B is an unsaturated 5- to 6-membered ring selected from the group consisting of phenyl, furyl, pyridyl, thienyl and indolyl.

19. The composition as claimed in claim 17, wherein the alkyl group has a hydrophilic functional group as a substituent.

20. The composition as claimed in claim 15, wherein the color developer composition is substantially free of benzyl alcohol.

21. The composition as claimed in claim 15, wherein the compound represented by general formula (I-1) or (I-2) is included in an amount of 0.01~50 g per liter of the color developer composition.

22. The composition as claimed in claim 15, wherein $R^3$ and $R^4$ have 1~10 carbon atoms.

23. The composition as claimed in claim 15, wherein the compound represented by general formula (II) is included in an amount of 0.1~20 g per liter of the color developer composition.

24. The composition as claimed in claim 15, wherein the aromatic primary amine color developing agent is selected from p-phenylenediamine derivatives.

25. The composition as claimed in claim 15, wherein the aromatic primary amine color developing agent is included in an amount of 0.1~20 g per liter of the developer composition.

26. The composition as claimed in claim 15, wherein $R^3$ and $R^4$ are each independently an alkyl group having 1 to 10 carbon atoms or an alkenyl group having 2 to 10 carbon atoms.

27. The composition as claimed in claim 15, wherein $R^3$ and $R^4$ may form a heterocyclic ring through a nitrogen atom.

28. The composition as claimed in claim 15, wherein the alkyl group and the alkenyl group may be straight-, branched-chain, or cyclic, and the substituents thereof are selected from the group consisting of a halogen atom, an aryl group, an alkoxy group, an aryloxy group, a sulfonyl group, a sulfonamido group, a sulfamoyl group, a carbamoyl group, an amido group, a ureido group, an alkoxycarbonylamino group, an aryloxycarbonylamino group, an alkoxycarbonyl group, an aryloxycarbonyl group, a cyano group, a hydroxy group, a carboxy group, a sulfo group, a nitro group, an amino group, an alkylthio group, an arylthio group and a heterocyclic group.

29. The composition as claimed in claim 15, wherein the nitrogen-containing heterocyclic rings that may be formed by $R^3$ and $R^4$ are selected from the group consisting of a piperidyl group, a pyrrolidyl group, an N-alkylpiperazyl group, a morpholinyl group, an indolinyl group, and a benztriazole group.

30. The composition as claimed in claim 15, wherein the substituents of $R^3$ or $R^4$ are selected from the group consisting of a hydroxyl group, an alkoxy group, an alkylsulfonyl group, a arylsulfonyl group, an amido group, a carboxyl group, a cyano group, a sulfo group, a nitro group, and an amino group.

* * * * *